US005658073A

United States Patent [19]

Lee

[11] Patent Number: 5,658,073

[45] Date of Patent: Aug. 19, 1997

[54] SUPPORTING STRUCTURE FOR A FIGURE-FORM CANDLE LAMP

[75] Inventor: Sam Lee, Taipei, Taiwan

[73] Assignee: Studio Eluceo Ltd., Taipei, Taiwan

[21] Appl. No.: 570,012

[22] Filed: Dec. 14, 1995

[51] Int. Cl.[6] ..... F21P 1/02

[52] U.S. Cl. ..... 362/392; 362/414; 362/810

[58] Field of Search ..... 362/161, 181, 362/226, 392, 410, 414, 415, 810, 806

[56] References Cited

U.S. PATENT DOCUMENTS

| | | | |
|---|---|---|---|
| 1,861,360 | 5/1932 | Rebl | 362/392 |
| 3,233,093 | 2/1966 | Gerlat | 362/810 |
| 3,760,177 | 9/1973 | Levy | 362/392 |
| 4,731,718 | 3/1988 | Sheu | 362/392 |
| 5,327,332 | 7/1994 | Hafemeister | 362/392 |

*Primary Examiner*—Alan Cariaso

*Attorney, Agent, or Firm*—Beveridge, DeGrandi, Weilacher & Young, L.L.P.

[57] ABSTRACT

Disclosed is a supporting structure associated with a base of a candle lamp for internally reenforcing a plastic figure-form shell of the candle lamp. The supporting structure includes a long hollow tubular member and a sleeve member. The tubular member has an enlarged top portion for receiving a lamp socket therein and a lower end for inserting into an upper portion of the sleeve member. The sleeve member has a lower connecting portion for associating with a lamp base. Thereby, a plastic figure-form shell of the candle lamp can be put over the supporting structure without easily becoming deformed or bent after assembly.

8 Claims, 11 Drawing Sheets

SUPPORTING STRUCTURE FOR A FIGURE-FORM CANDLE LAMP

BACKGROUND OF THE INVENTION

1. Field of the Invention

The present invention relates to a supporting structure, and more particularly to a supporting structure used inside a figure-form candle lamp for supporting an outer plastic-made figure-form shell and protecting the same from damage due to deformation.

2. Description of the Prior Art

A candle lamp is a popular ornamant which is particularly welcomed during the Christmas Holidays. FIG. 1 illustrates a conventional candle lamp which includes a base 10, a long and straight tubular member 11 disposed on the base 10, a socket 12 provided to a top of the tubular member 11, and a bulb 13 connected to the socket 12. The long tubular member 11 usually has a simple configuration and therefore can be made of hard plastic material without the problem of deformation. It is not necessary to consider any internal structural problem which might occur during transportation or storage of the candle lamp. However, such candle lamp is limited to a quite simple and monotonous form.

To satisfy the specific seasonal and esthetical requirement, there are candle lamps developed with the long tubular member 11 in different designs, such as an angel, a Santa Claus, a witch, etc., to increase the entertaining effect of the whole candle lamp.

These tubular members in the form of an angel, Santa Claus, witch, etc., are different from those straight tubular members 11, because they have asymmetrical shape and non-smooth appearance, and must be painted differently than the straight tubular members 11. These irregularly shaped tubular members can not be properly made of the hard plastic material as the conventional straight candle lamps. Instead, they must be made of vinyl plastic material. For example, a figure-form mold made by injection molding is turned at high speed while liquid vinyl plastic material is poured into the turning mold, so that the plastic material attaches to an inner surface of the mold, forming a hollow figure-form shell. The shell is then coated with color paints.

FIG. 2 illustrates an example of the conventional figure-form candle lamp. As shown, the straight tubular member 11 is replaced by a figure-form member without any additional inner reinforcement. Since the figure-form member is a shell made of softer vinyl plastic, it has weaker supporting ability. Particularly, it tends to break or deform due to collision in transportation. In addition, it is apt to bend and becomes useless when the figure-form candle lamp is shipped by a container in which a high temperature exists.

SUMMARY OF THE INVENTION

A primary object of the present invention is to provide supporting structure for a figure-form candle lamp. The supporting structure mainly includes a tubular member and a sleeve member. The tubular member has a top end with socket for receiving a bulb disposed thereinto and a bottom end inserted into the sleeve member while a plastic-made figure-form shell is put over the tubular member. The sleeve member is then connected at its lower end to a base of the candle lamp. This supporting structure largely reinforces the plastic figure-form shell, protecting the same from deformation due to collision or bending due to high ambient temperature.

Another object of the present invention is to provide a supporting structure for a figure-form candle lamp. The supporting structure can be easily assembly without adversely affecting the assemble of the candle lamp itself.

BRIEF DESCRIPTION OF THE DRAWINGS

The features and the functions of the present invention can be best understood by referring to the following detailed description of the preferred embodiments and the accompanying drawings, wherein.

DETAILED DESCRIPTION OF THE PREFERRED EMBODIMENTS

Figure 3:
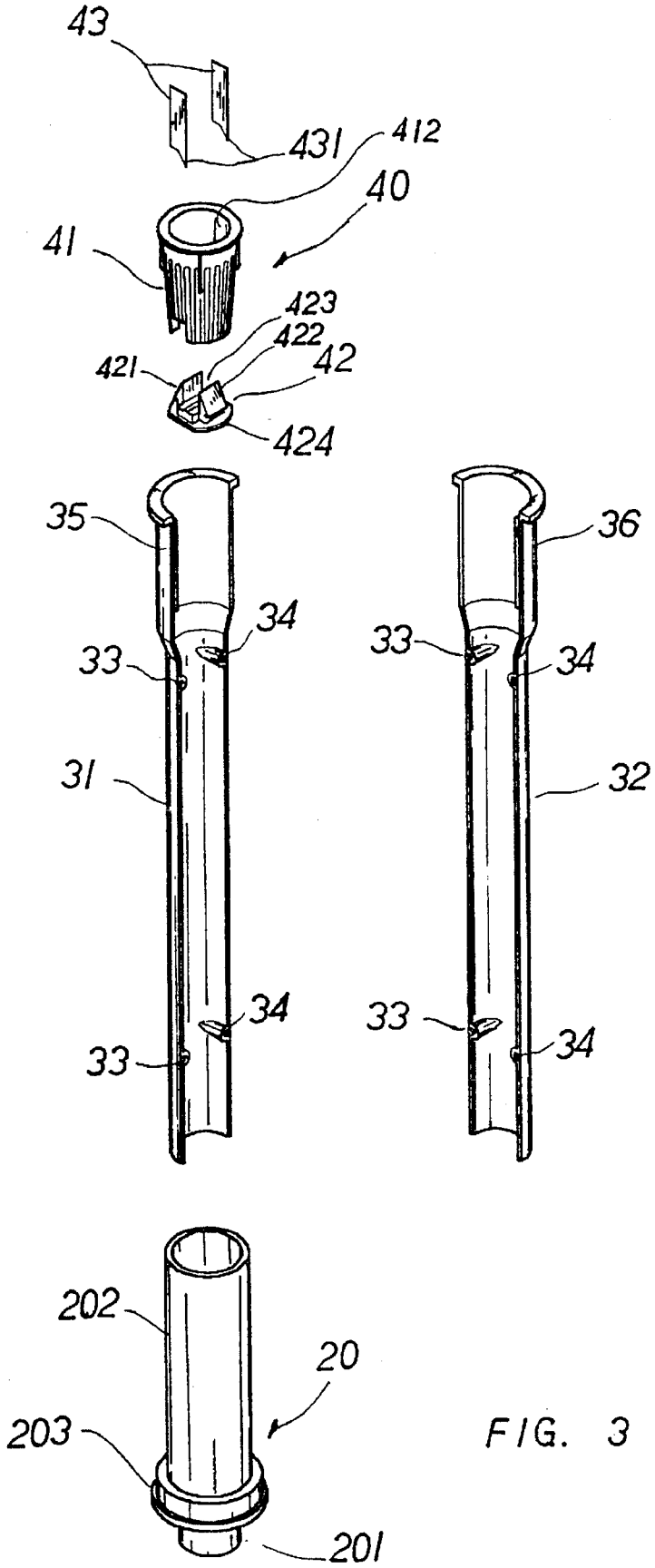
FIG. 3 is an exploded perspective of a supporting structure according to the present invention.
Figure 4:
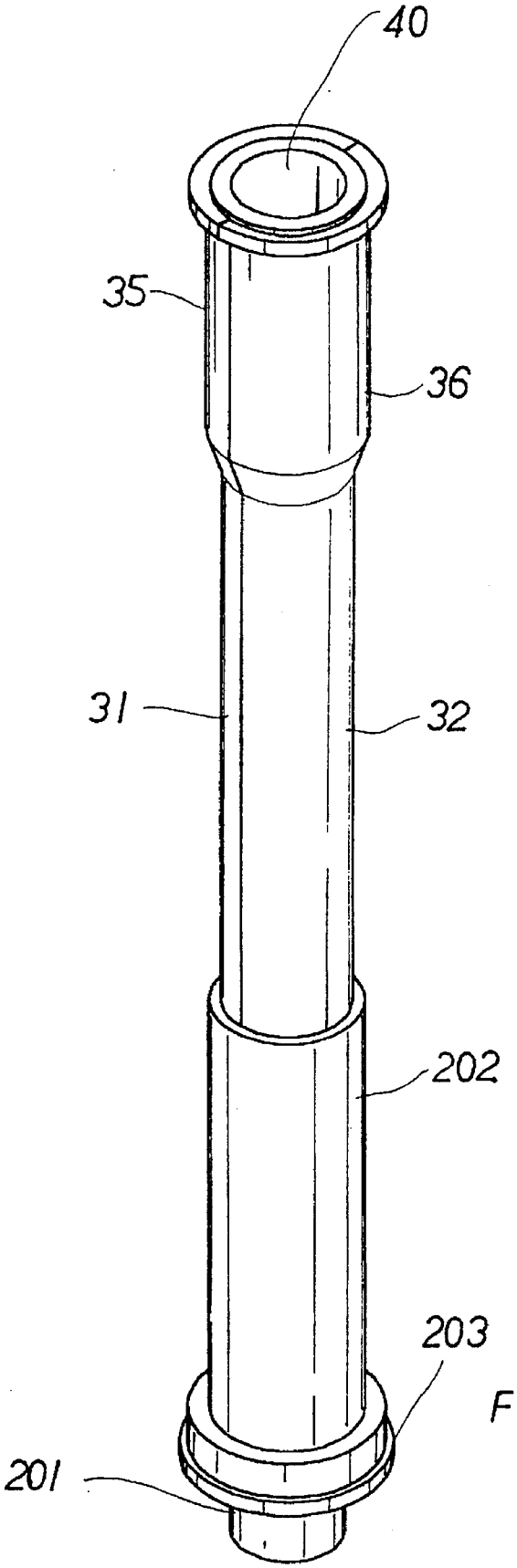
FIG. 4 is an assembled perspective of the supporting structure of FIG. 3.
Figure 5:
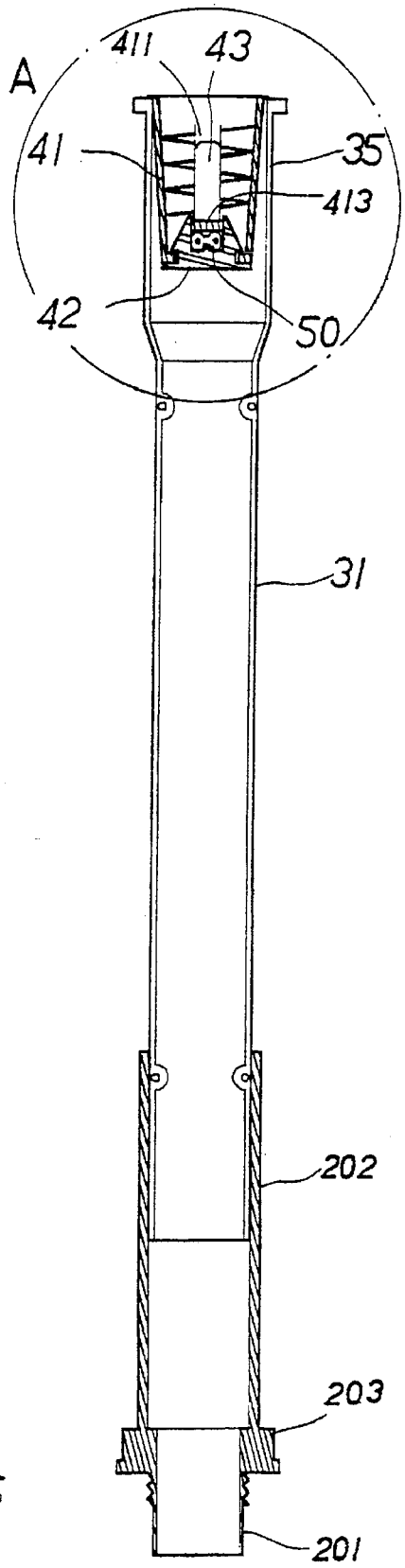
FIG. 5 is a sectional view of the supporting structure of the present invention.

Please refer to FIGS. 3, 4 and 5. The present invention is a supporting structure for a candle lamp, including a bottom sleeve member 20, a middle tubular member assembled from two symmetrical halves 31, 32, and a top lamp socket 40.

Figure 1:
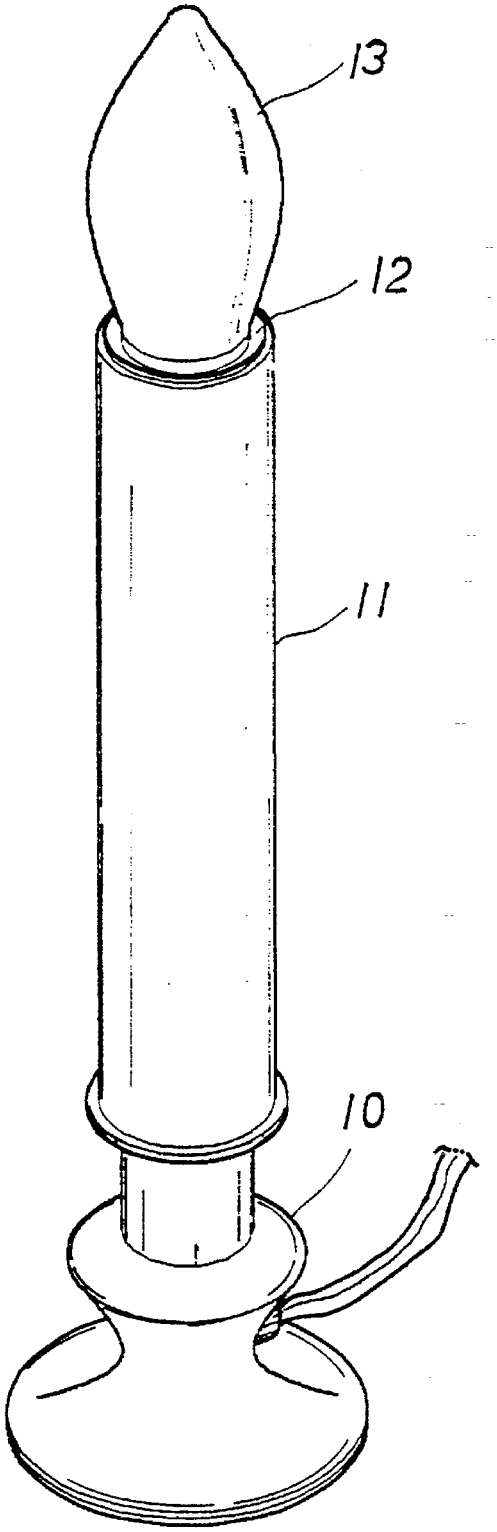
FIG. 1 PRIOR ART
FIG. 1 is a perspective of a conventional candle lamp with straight tubular member.
Figure 2:
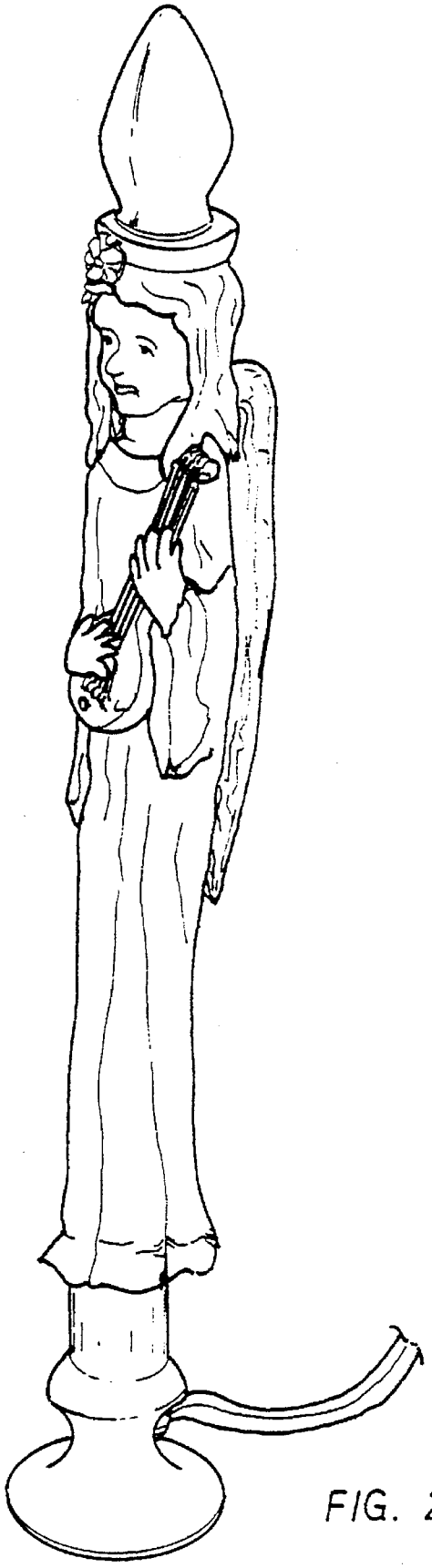
FIG. 2 PRIOR ART
FIG. 2 is a perspective of another conventional candle lamp with a figure-form tubular member.

The sleeve member 20 has a lower connecting portion 201 for associating with a lamp base 10 (either the one shown in FIG. 1 or the one shown in FIG. 7), an upper hollow tubular portion 202 for connecting with the middle tubular member, and an enlarged middle retaining portion 203 for preventing the sleeve member 20 from being inserted to far into the base 10.

The symmetrical halves 31, 32 are provided at their joining edges with complementary projected blocks 33 and recesses 34, so that the two halves 31, 32 can be fitly and firmly assembled together by the engagement of the projected blocks 33 with the recesses 34 to form the middle tubular member for wires 50 to pass therethrough. The assembled middle tubular member has a bottom end which can be fitly inserted into the upper hollow tubular portion 202 of the sleeve member 20. The assembled middle tubular member has a top end consisting of two enlarged parts 35, 36, defining a room for receiving the lamp socket 40 therein.

Figure 5A:
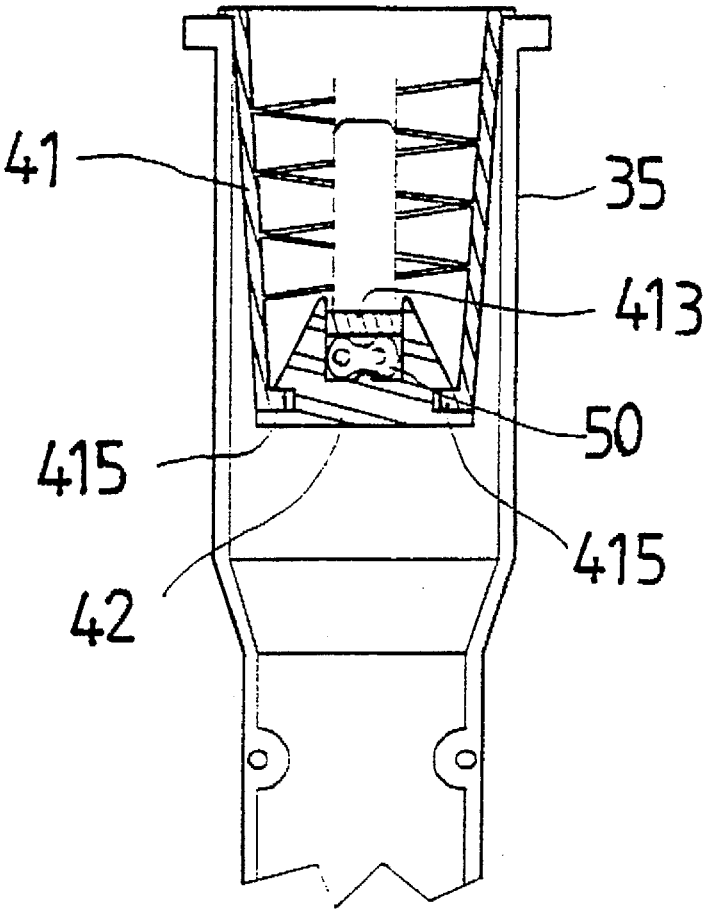
FIG. 5A is an enlarged view of section A of FIG. 5.

The lamp socket 40 includes a cylindrical body 41, a lower cap 42, and a pair of conductive plates 43. The cylindrical body 41 can be forced into the room defined by the enlarged parts 35, 36 at the top end of the middle tubular member and be fixed therein. The lower cap 42 includes a bottom plate 424. The lower cap 42 is retained by an inward extended flange 415, as shown in FIG. 5A, around a lower edge of the .cylindrical body 41 by means of two retaining wings 421, 422 oppositely formed on the bottom plate 424 to engage the inward extended flange 415 of the cylindrical body 41. Electrical wires 50 are restricted by the two retaining wings 421, 422 to extend along a gap 423 between the wings 421, 422 and be fixed therein, as shown in FIG. 5.

Figure 6:
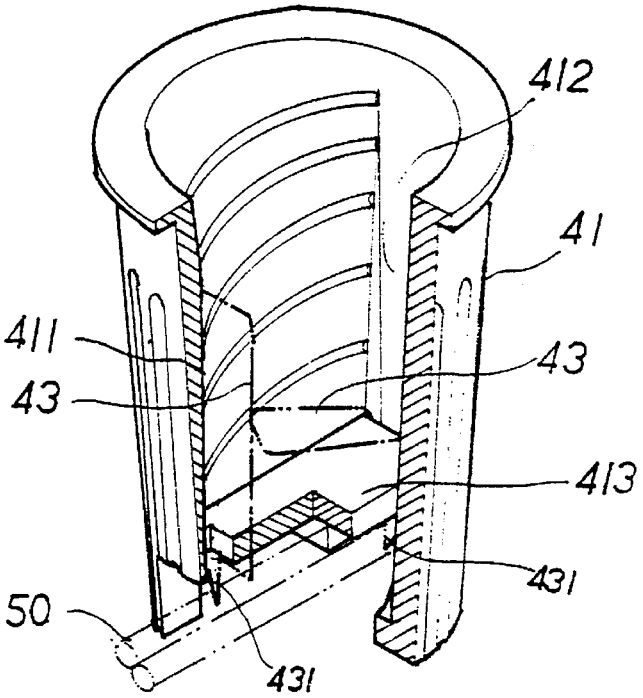
FIG. 6 is a perspective of the bulb socket of the present invention, a part of which being taken away to better show the inner arrangements, wherein the thin broken line indicates the wires and the thick broken line indicates the conductive plates.

The cylindrical body 41 is formed at its inner wall surface with a pair of vertically extended and oppositely located recesses 411, 412 to separately receive one conductive plate 43 therein. A crossbar 413 extends across a lower portion of the cylindrical body 41 to separate the two conductive plates 43 from each other and to work with the lower cap 42 to fix the wires 50 in the gap 423. There are threads formed on the inner wall surface of the cylindrical body between the two recesses 411, 412 for engaging with a bulb 70. The two conductive plates 43 have a pointed lower end 431 for piercing the insulation skin of one wire 50 being held between the crossrod 413 and the lower cap 42, forming an electrical connection, as shown in FIG. 6.

Figure 7:
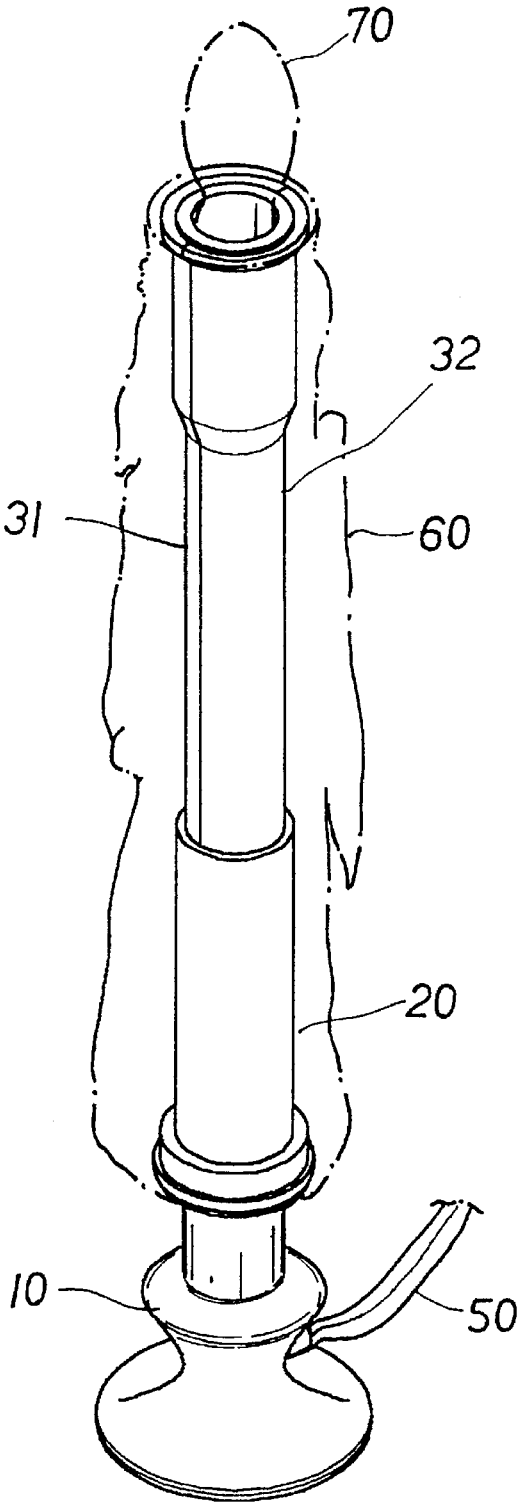
FIG. 7 shows the manner in which the supporting structure of the present invention after assembly with the lamp base, wherein the broken line indicates a figure-form plastic shell.

FIG. 7 illustrates the manner in which the supporting structure of the present invention is assembled with a plastic shell 60, the bulb 70, and the lamp base 10. The plastic shell 60 is put over the entire supporting structure, the bulb 70 is screwed into the lamp socket 40, and the connecting portion 201 of the sleeve membeer 20 of the supporting structure is associated with the lamp base 10.

Since the two halves 31, 32 are longitudinally extended members having a symmetrical semicircular cross section, they are suitable for forming from hard plastic material, providing the plastic shell 60 with excellent support, preventing the figure-form plastic shell 60 from deforming and bending even under high temperature when being transported in a container.

Figure 8:
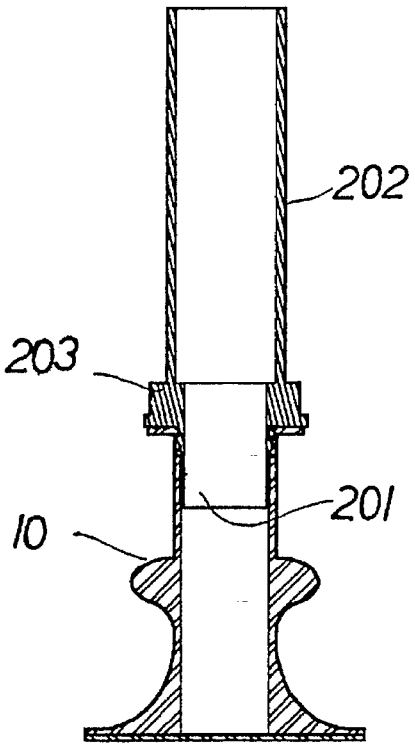
FIG. 8 is a cross, sectional view showing the assembling of the sleeve member of the supporting structure with the base of the candle lamp.

FIG. 8 illustrates a connecting portion 201 provided with external threads is screwed into the lamp base 10. This type of connection is suitable for a base 10 made of metal material.

Figure 9:
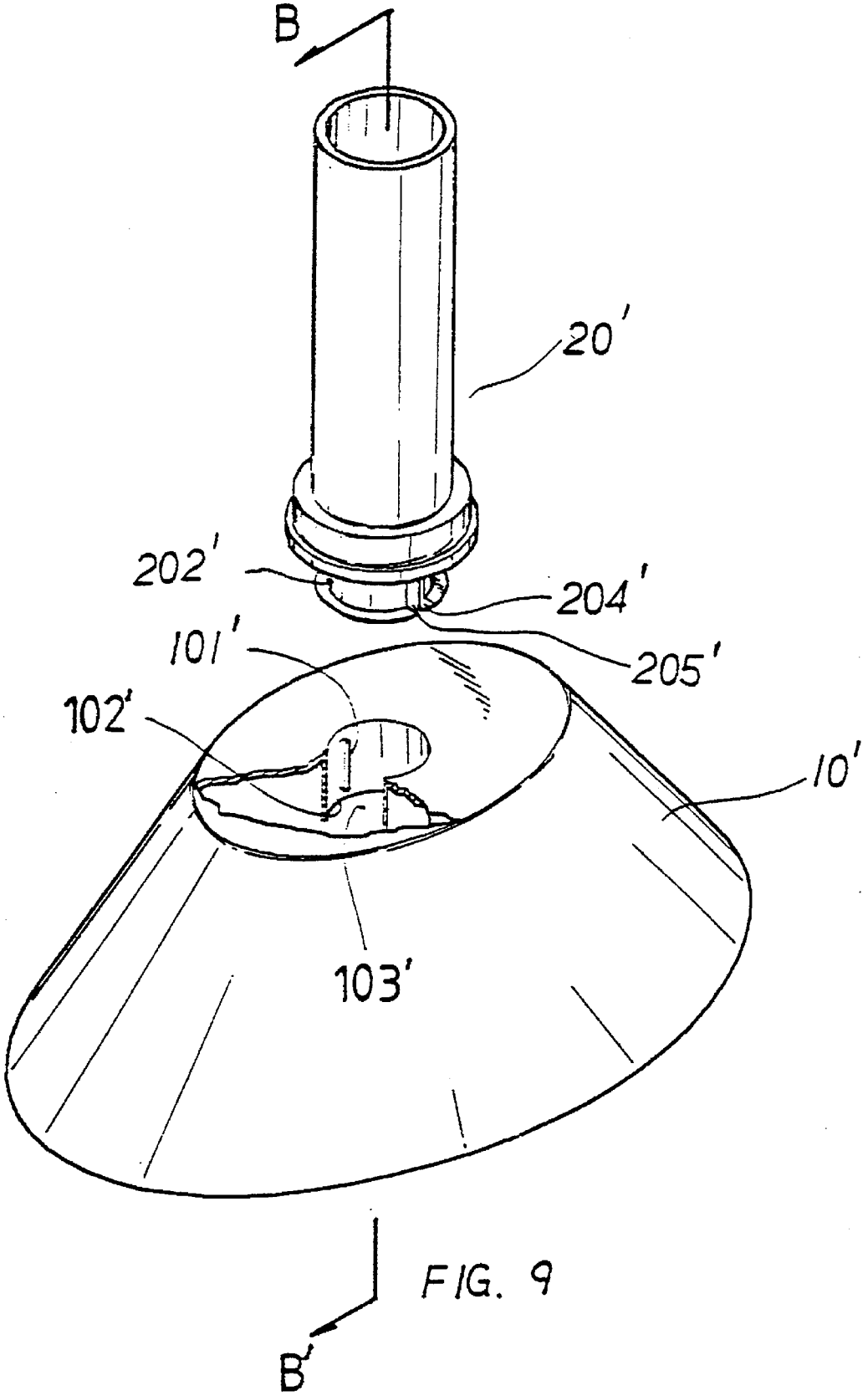
FIG. 9 illustrates a different sleeve member for the supporting structure and a different base for the candle lamp.
Figure 9A:
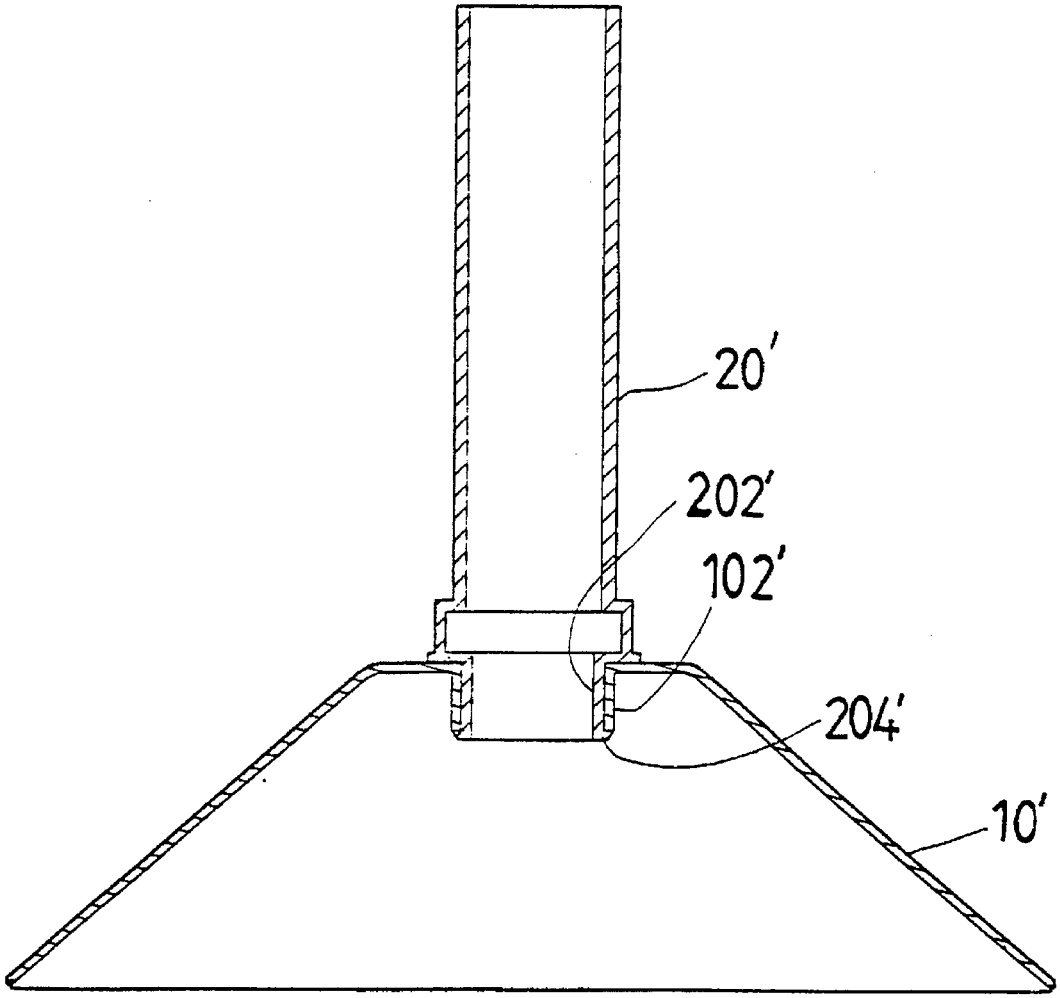
FIG. 9A is a cross section of FIG. 9 taken at B—B'

FIG. 9 illustrates another embodiment of the sleeve member 20' in which a lower connecting portion 201' has a lower end 204' which has a half-arrow-shaped cross section. A groove 205' is formed on an outer peripheral surface of the lower end 204' for engaging with a projection 101' formed on an inner peripheral wall 102' of a receiving hole 103' formed in the lamp base 10', so that the supporting structure of the present invention would not rotate relative to the base 10' after the sleeve member 20 is connected to the base 10'. This type of connection is suitable for a base 10' made of plastic material.

Figure 10:
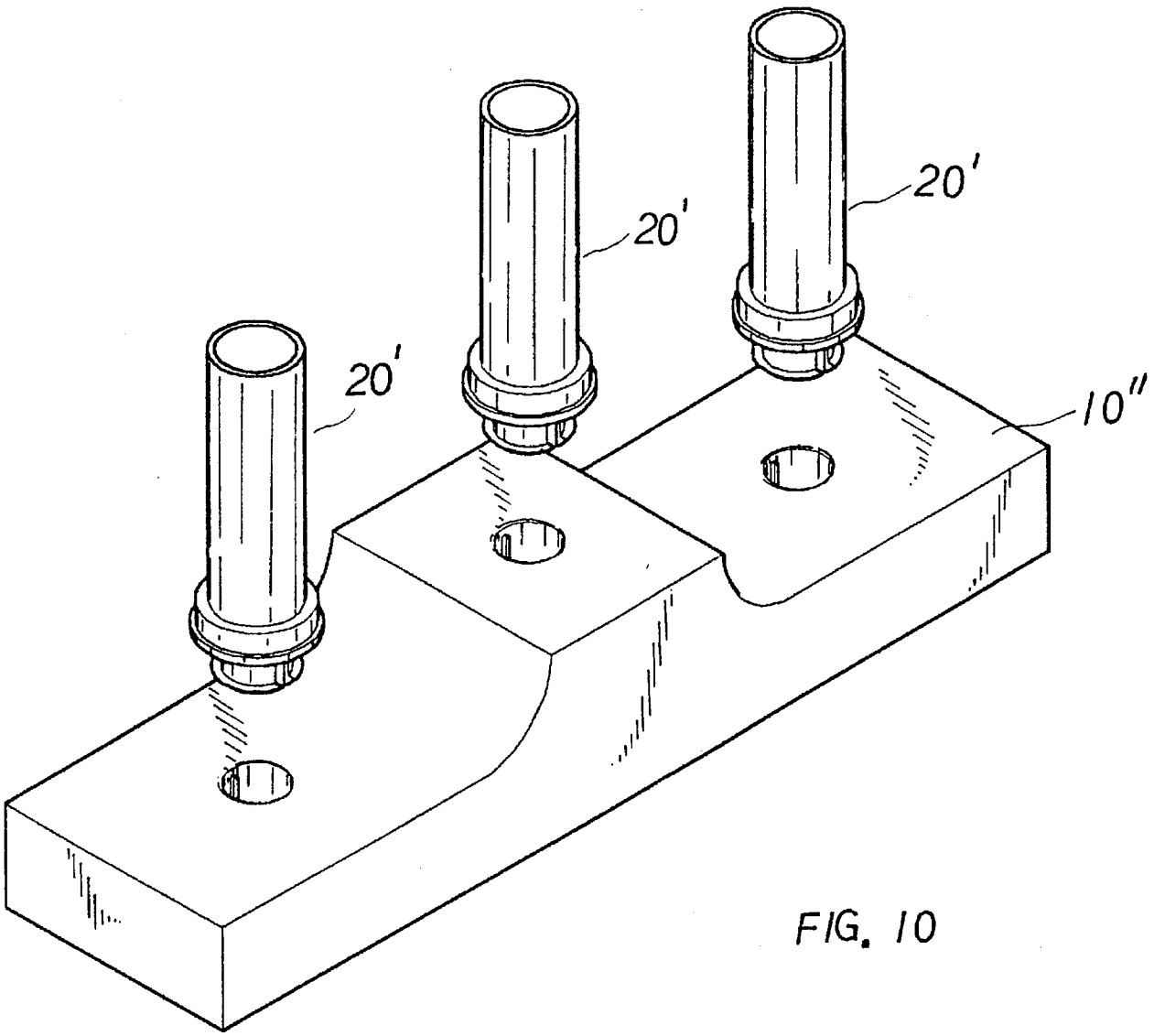
FIG. 10 illustrates more than one supporting structure is connected to a base with multiple receiving holes.

As shown in FIG. 10, the lamp base 10" may have multiple receiving holes formed thereon to connect with multiple pieces of the supporting structure, so that different figure-form plastic shells can be supported to form a set of candle lamps.

Figure 11:
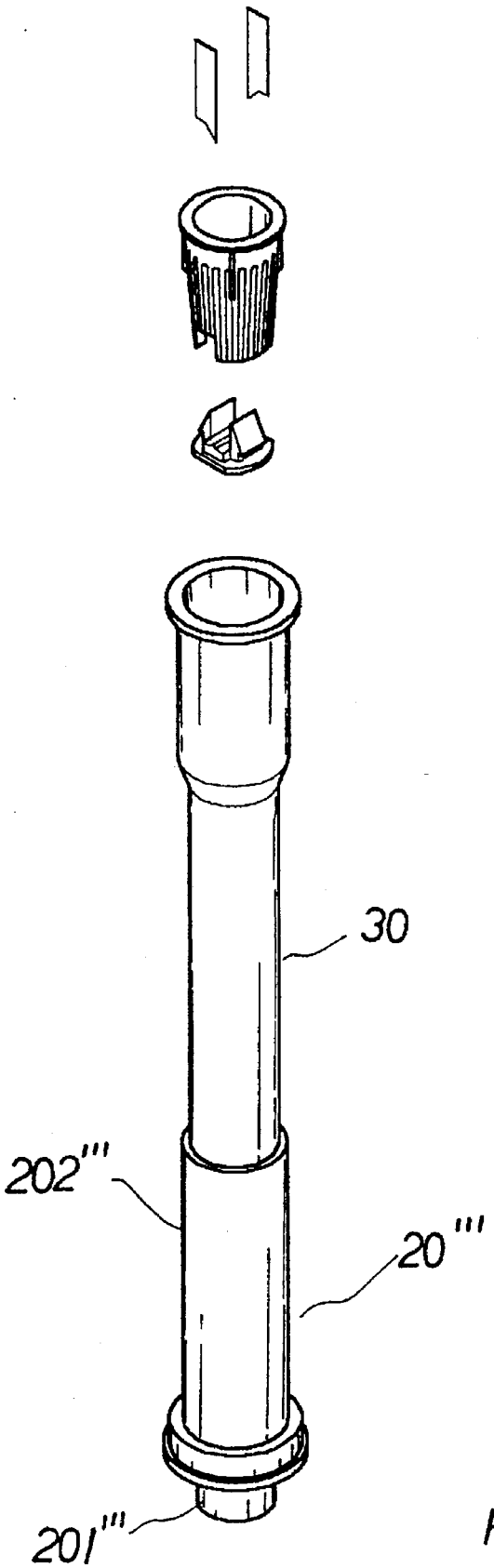
FIG. 11 is an exploded perspective illustrating another embodiment of the present invention in which the tubular member and the sleeve member are integrally formed.

FIG. 11 illustrates still another embodiment of the present invention wherein the tubular member 30 and the upper hollow tubular portion of the sleeve member 20''' are integrally formed and thereby simplifies the assembling of the present invention. The lower connecting portion 201''' of the sleeve member 20''' may be designed to either have external threads or have a half-arrow-shaped cross section to connect to the lamp base 10.

What is claimed is:

1. A supporting structure for internally reenforcing a plastic figure-form candle lamp, comprising:

a base;

a sleeve member having a lower connecting portion for engaging said base, an upper hollow tubular portion, and a middle enlarged retaining portion between said upper hollow tubular portion and said lower connecting portion;

a long hollow tubular member being made of hard plastic material for electrical wires to pass therethrough, said long hollow tubular member having an attached pair of symmetrical halves, said attached pair of symmetrical halves having a lower end engaged with said upper hollow tubular portion of said sleeve member and an enlarged upper end defining a room; and a lamp socket being mounted in said room defined by said enlarged upper end of said attached pair of symmetrical halves and being provided with an inner wall surface with threads for a bulb to screw thereinto, said lamp socket having two conductive plates disposed therein to connect with said wires and thereby forming an electrical connection with two electrodes of the bulb.

2. A supporting structure as claimed in claim 1, wherein said symmetrical halves forming said long tubular member have along their joining edges a plurality of complementary projected blocks and recesses whereby said plurality of projected blocks engage said plurality of recesses to connect said symmetrical halves together.

3. A supporting structure for internally reenforcing a plastic figure-form candle lamp, comprising:

a base;

a sleeve member having a lower connecting portion for engaging said base, an upper hollow tubular portion, and a middle enlarged retaining portion between said upper hollow tubular portion and said lower connecting portion;

a long hollow tubular member being made of hard plastic material for electrical wires to pass therethrough, said long hollow tubular member having a lower end engaged with said upper hollow tubular portion of said sleeve member and an enlarged upper end defining a room; and a lamp socket being mounted in said room defined by said enlarged upper end of said long hollow tubular member and being provided with an inner wall surface with threads for a bulb to screw thereinto, said lamp socket having two conductive plates disposed therein to connect with said wires and a cylindrical body, said conductive plates forming an electrical connection with two electrodes of the bulb, and said cylindrical body engages said room of said enlarged upper end of said long hollow tubular member and having a lower cap attached to a bottom of said cylindrical body.

4. A supporting structure as claimed in claim 3, wherein said lower cap includes a bottom plate on which two oppositely located retaining wings are formed, said retaining wings engaging an inward extended flange formed on said bottom of said cylindrical body to attach said lower cap to said cylindrical body.

5. A supporting structure as claimed in claim 4, wherein said cylindrical body is provided at an inner wall surface with two vertically extended long recesses to each receive one of said conductive plates.

6. A supporting structure as claimed in claim 5, wherein said cylindrical body has a crossbar disposed therein near a lower portion thereof to separate said two conductive plates from each other and together with said lower cap hold said wires in place.

7. A supporting structure as claimed in claim 6, wherein said two conductive plates are fixed into said vertical recesses and each has a pointed lower end to pierce through an insulation skin of one of said wires restricted in place by said lower cap and said crossbar to form an electrical connection.

8. A supporting structure for internally reenforcing a plastic figure-form candle lamp, comprising:

a base having a receiving hole, said receiving hole having an inner peripheral wall with a projected block;

a sleeve member having a lower connecting portion for engaging said base, an upper hollow tubular portion, and a middle enlarged retaining portion between said upper hollow tubular portion and said lower connecting portion, said lower connecting portion has a lower end having a half-arrow-shaped cross section and a groove in an outer peripheral wall to engage said projected block of said base;

a long hollow tubular member being made of hard plastic material for electrical wires to pass therethrough, said long hollow tubular member having a lower end engaged with said upper hollow tubular portion of said sleeve member and an enlarged upper end defining a room; and a lamp socket being mounted in said room defined by said enlarged upper end of said long hollow tubular member and being provided with an inner wall surface with threads for a bulb to screw thereinto, said lamp socket having two conductive plates disposed therein to connect with said wires and thereby forming an electrical connection with two electrodes of the bulb.

* * * * *